US005246260A

United States Patent [19]

Racicot

[11] Patent Number: 5,246,260

[45] Date of Patent: Sep. 21, 1993

[54] RETRIEVER FOR GOLF BALLS IN WATER HAZARDS

[76] Inventor: Conrad Racicot, P.O. Box 305, Espanola, Ontario, Canada, P0P 1CO

[21] Appl. No.: 8,725

[22] Filed: Jan. 22, 1993

Related U.S. Application Data

[63] Continuation-in-part of Ser. No. 863,745, Apr. 6, 1992, abandoned.

[51] Int. Cl.[5] ..... A01D 7/06; A63B 47/02

[52] U.S. Cl. ..... 294/19.2; 56/400.11; 294/55

[58] Field of Search ..... 294/19.2, 52, 53.5, 294/55, 55.5, 56, 66.1; 37/119, 120; 56/328.1, 332, 400.14–400.09, 400.11–400.19, 400.21; 273/32 F, 162 E

[56] References Cited

U.S. PATENT DOCUMENTS

| | | | |
|---|---|---|---|
| 647,724 | 4/1900 | McCoy | 37/119 |
| 1,095,585 | 5/1914 | Mack | 294/55 X |
| 1,141,423 | 6/1915 | Simas | 37/119 |
| 2,738,214 | 3/1956 | Zimmers | 294/19.2 |
| 2,864,228 | 12/1958 | Griffith | 294/19.2 X |
| 2,989,836 | 6/1961 | Schaffer | 294/55.5 X |
| 3,979,890 | 9/1976 | Schenk | 56/400.11 X |
| 4,254,981 | 3/1981 | Wilson | 294/19.2 |
| 4,411,463 | 10/1983 | Alderman | 294/19.2 |
| 4,635,987 | 1/1987 | Hurtgam | 294/19.2 |
| 4,974,894 | 12/1990 | Dubow | 294/19.2 |

*Primary Examiner*—Johnny D. Cherry
*Attorney, Agent, or Firm*—Stanley M. Miller

[57] ABSTRACT

A rake-like device for retrieving golf balls includes an elongate handle and a ball retriever that is made from a plurality of "U"-shaped tine members disposed in transversely spaced apart relation to one another. The open end of each tine faces the user of the device during the retrieving operation. A triangular structure is formed on the bottom part of each tine and serves to trap a retrieved golf ball. The handle is pivotally mounted to the retriever so that the device can be stored in a narrow space when not in use.

8 Claims, 5 Drawing Sheets

RETRIEVER FOR GOLF BALLS IN WATER HAZARDS

CROSS REFERENCE TO RELATED APPLICATIONS

This disclosure is a continuation-in-part of Ser. No. 07/863,745, filed Apr. 6, 1992, now abandoned by the same inventor.

FIELD OF THE INVENTION

This invention relates, generally, to golf ball retrievers. More particularly, it relates to a golf ball retriever especially designed to facilitate retrieval of golf balls from ponds or other water hazards.

DESCRIPTION OF THE PRIOR ART

Many golf ball retrievers are defeated if a golf ball is lost in a pond or other water hazard. Other retrievers work well in water hazards that are free of weeds, grasses, and other obstructions. Some retrievers can defeat weeds and grasses, but cannot retrieve a ball if it is stuck in sand or mud under water. However, a golf ball retriever capable of retrieving golf balls from under water where the ball is stuck in the mud or other substance and where weeds and grasses are present in profusion was heretofore unknown.

Some of the earlier devices have been provided in the form of rakes. Examples of rake-like devices are shown in U.S. Pat. Nos. 4,411,463 to Alderman and 3,306,650 to Zagwyn.

A device intended to retrieve golf balls from mud and silt is shown in U.S. Pat. No. 4,635,987 to Hurtgam; it includes curved tines that are connected to one another along a leading edge thereof, but lacks structure for holding a ball once it is retrieved.

A prune gatherer used in a rake-like fashion is shown in U.S. Pat. No. 1,095,585 to Mack. Still further structures of interest include a golf ball retriever shown in U.S. Pat. No. 2,738,214 to Zimmers, and a golf ball retrieving rake shown in U.S. Pat. No. 4,411,463 to Alderman.

The prior art, when considered as a whole as required by law, neither taught nor suggested to those of ordinary skill in this art, at the time the present invention was made, how the art could be further advanced. The conventional wisdom has been for years that the art of golf ball retrievers had already reached its pinnacle, and that no further breakthroughs were in the offing.

SUMMARY OF THE INVENTION

A revolutionary new design in golf ball retrievers is now disclosed. Not only does it defeat water, weeds and grasses growing in the water, and mud or silt, it also includes means for retaining a retrieved ball until it has been returned to the grasp of its owner.

The device is attached to the distal end of an elongate handle; it includes plural tines, each of which is disposed in a vertical plane and positioned equidistantly from its contiguous tines. Each tine has a general "U"-shape and is positioned so that the open part of the "U" faces the person holding the handle during a ball retrieving operation. A triangular frame disposed in a vertical plane is formed along the lower, forward part of each "U"-shaped tine; said frames do not extend rearwardly to the bight part of each tine. Thus, a retrieved ball is dug out of silt or mud by the free end of each tine and is constrained to be lifted from the mud by the leading end of the triangular frame. Upon attaining the apex of the frame, the ball is constrained to enter into the bight region of the tines, and the trailing end of the triangular frame then prevents it from escaping therefrom unless seized and removed therefrom by a human hand.

A framework of three transversely disposed stabilizer bars holds the tines in their operative configuration, and a unique handle attachment means enables folding of the handle when it is not in use to facilitate storage of the device.

The primary object of this invention is to advance the art of golf ball retrievers by providing a golf ball retriever that can retrieve balls from under water, even in the presence of weeds and grasses and even if the ball is stuck in mud o silt.

Another object is to provide a golf ball retriever that does not drop balls before they are fully retrieved.

These and other important objects, features, and advantages of the invention will become clear as this description proceeds.

The invention accordingly comprises the features of construction, arrangement of parts, and combination of elements that will be hereinafter set forth, and the scope of the invention will be indicated in the claims.

BRIEF DESCRIPTION OF THE DRAWINGS

For a fuller understanding of the invention, reference should be made to the following detailed description and to the accompanying drawings, wherein.

Similar reference numerals refer to similar parts throughout the several views of the drawings.

DETAILED DESCRIPTION OF THE PREFERRED EMBODIMENT

Figure 1:
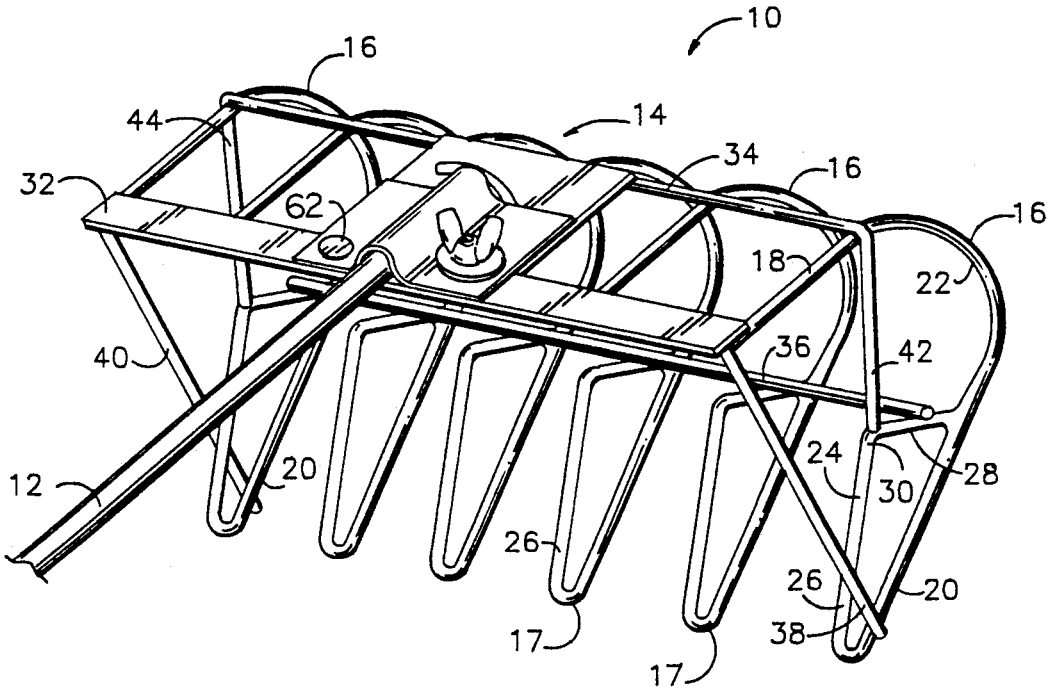
FIG. 1 is a perspective view of an exemplary embodiment of the invention.
Figure 2:
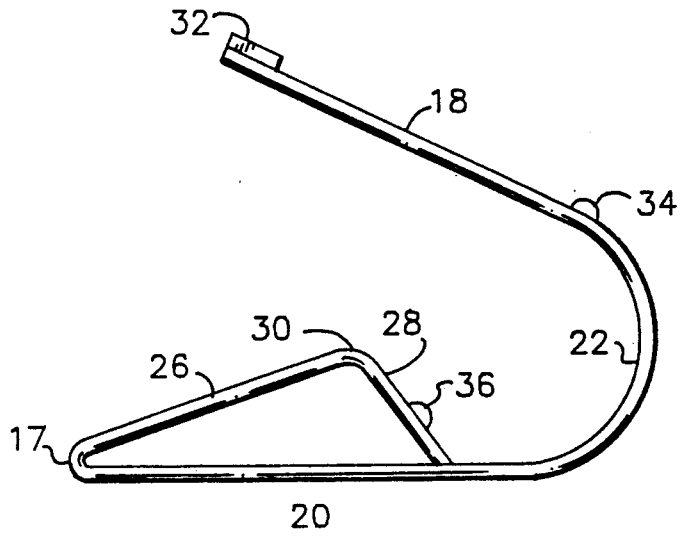
FIG. 2 is a side elevational view of a center tine.

Referring now to FIG. 1, it will there be seen that a first illustrative embodiment of the invention is denoted as a whole by the reference numeral 10. The elongate handle of the retriever apparatus 10 is denoted 12, and the retriever part of said apparatus is generally designated 14.

It will be noted that six tines are provided in this particular embodiment, but that number is not critical. In this particular embodiment, there are four central tines and two outer tines. All of the tines are collectively denoted 16, because they share a common structure. Each tine 16 is longitudinally aligned, i.e., is parallel to handle 12, and is transversely spaced apart from its contiguous tines in equidistantly spaced relation thereto. Moreover, each tine is disposed in a vertical plane. All of the tines have a generally "U"-shaped configuration, and are oriented so that the open, leading end of the "U" faces the individual holding handle 12 and so that the closed, trailing end of said "U" is remote from said user.

Each tine 16 includes a straight upper part 18, a straight lower part 20, and a return bend part or bight 22 that is remote from the user when the device is in use, that interconnects said upper and lower parts, and which is integrally formed therewith; said bight part is the aforementioned closed end of the tine.

A triangular structure, denoted 24 as a whole, is connected to each lower part and includes upwardly inclined, rearwardly extending leading part 26, downwardly inclined, rearwardly extending trailing part 28, and apex 30. Note that the upward slope of leading part 26 is quite gradual, whereas the downward slope of the trailing part 28 is much steeper. The significance of this feature will be pointed out hereinbelow.

The leading ends of each upper part 18 are connected to forward, flat stabilizer bar 32, and the trailing ends of each upper part 18 are similarly connected to rearward, rod-like stabilizer bar 34. A third or lower stabilizer bar, denoted 36, is also rod-like and similarly interconnects the rearwardly extending trailing parts 28 near their respective trailing ends. All three stabilizer bars 32, 34, and 36 serve to maintain the transverse spacing of the tines. Forward stabilizer bar 32 diverts weeds and grasses so that the respective leading ends 17 of the tines 16 may dislodge balls imbedded in sand or mud.

Additional structural rigidity is provided by forward braces 38, 40, and rearward braces 42, 44. The forward braces 38, 40 are secured to and extend from opposite ends of flat stabilizer bar 32 to the leading parts of the outer tines, and the rearward braces 42, 44 connect the upper parts of the outer tines to apex 30 of the triangular structure. Note that said rearward braces 42, 44, are formed integrally with stabilizer bar 34.

The sharp leading end 17 of each tine digs into mud or silt easily. The gentle upward slope of leading part 26 of each triangular part 24 allows the ball being retrieved to roll up such slope until the apex 30 of the triangular structure is attained. Thereafter, the ball will roll down the steeper incline defined by trailing part 28 and become trapped in the bight region 22 of the tines. In other words, access into the bight area is easy, but egress therefrom is not. Thus, triangular structure 24 serves as a ball-trapping means.

Figure 4:
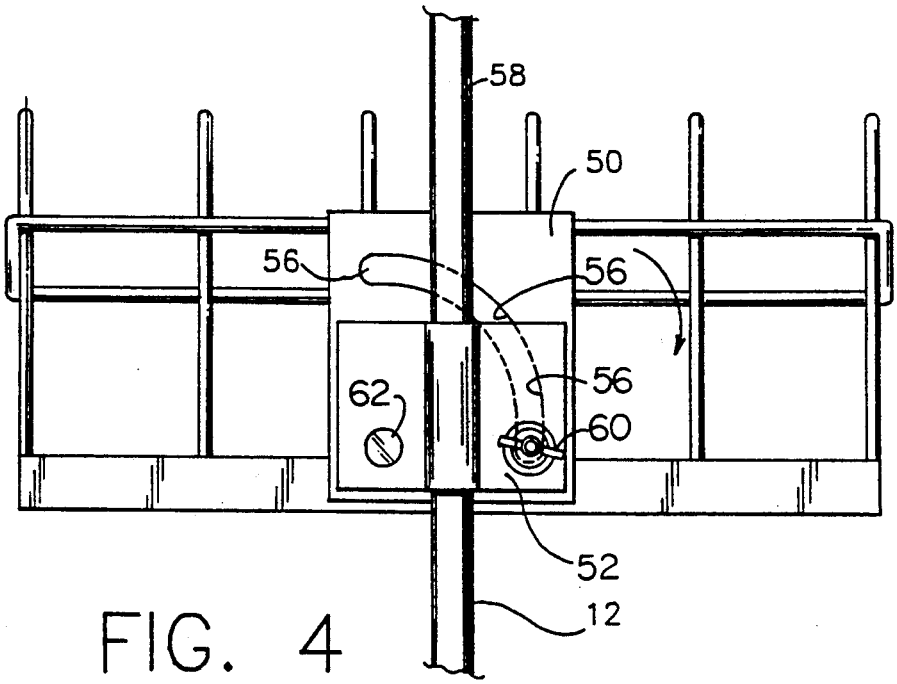
FIG. 4 is a top plan view thereof.
Figure 5:
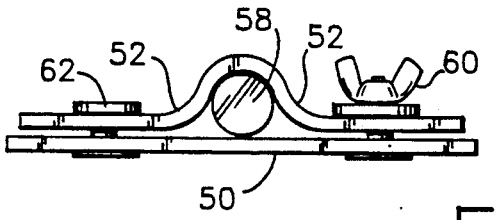
FIG. 5 is a front elevational view of the novel handle attachment system.
Figure 6:
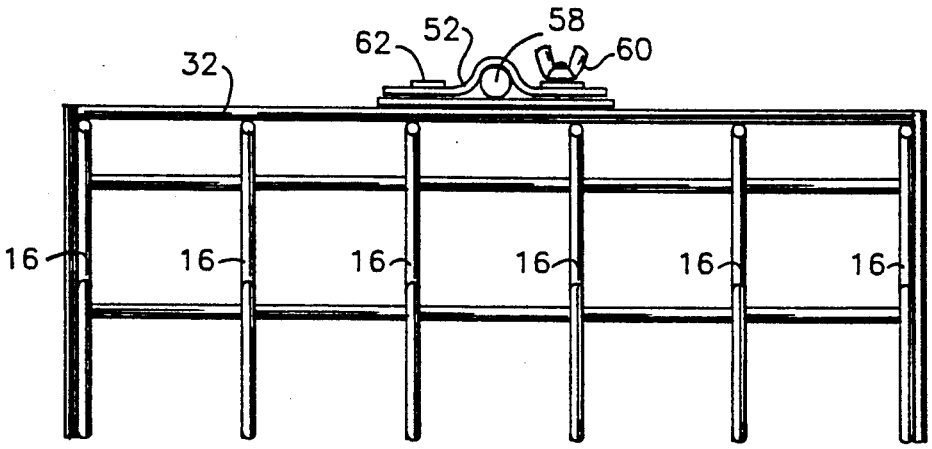
FIG. 6 is a front elevational view of the device.

Advantageously, the retriever part 14 of the apparatus may be rotated ninety degrees with respect to handle 12 to facilitate storage of retriever device 10. As perhaps best shown in FIG. 4, this is accomplished by sandwiching the distal end 58 of handle 12 between a flat plate 50 and bridge member 52 that is mounted to plate 50 at its opposite ends and which arches over said distal end 58 of handle 12 as perhaps best shown in FIGS. 5 and 6. One end of bridge 52 is secured to plate 50 by a rivet assembly including wing nut 60 and the other end is secured by a rivet means 62. An arcuate slot 56 is formed in flat plate 50 so that when wing nut 60 is loosened, the retriever assembly 14 may be rotated ninety degrees in the direction indicated by the directional arrow in FIG. 4 until the longitudinal axis of said assembly is parallel to the longitudinal axis of handle 12. Thus, little space is required to place device 10 into storage.

Figure 7:
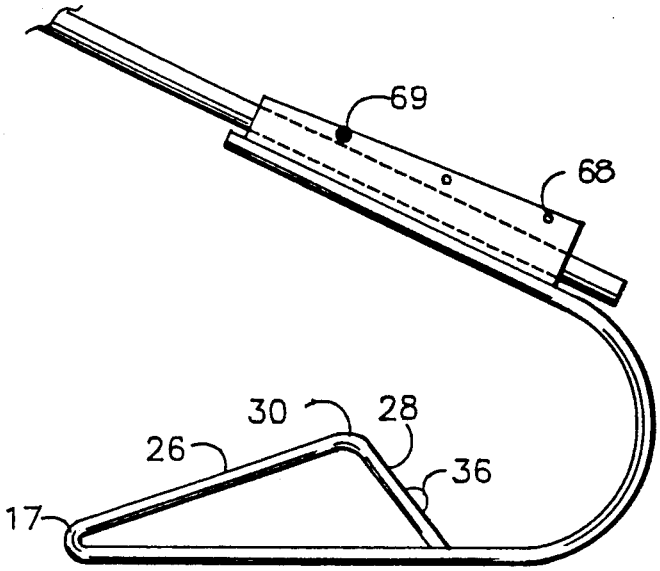
FIG. 7 is a side elevational view of an alternative handle attachment means.
Figure 8:
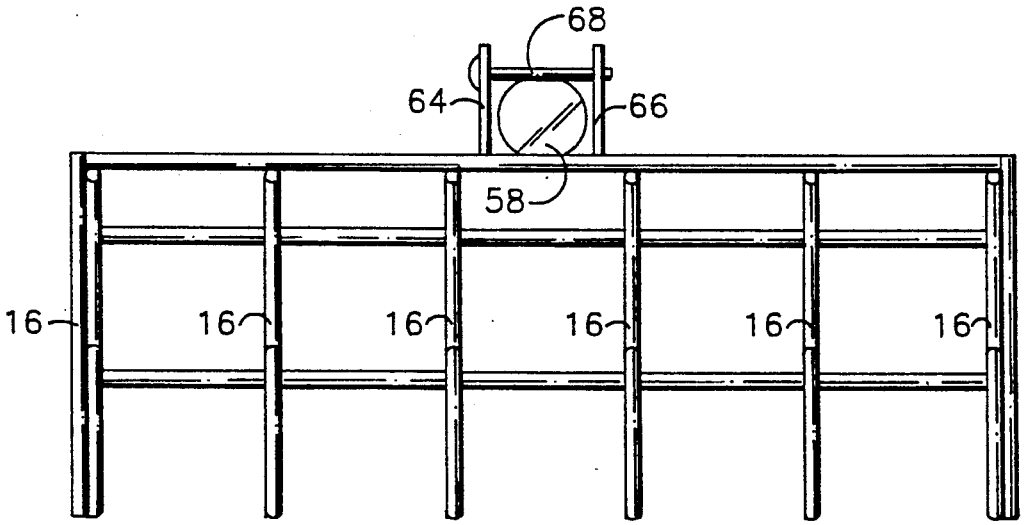
FIG. 8 is a front elevational view of the alternative handle attachment means of FIG. 7.

An alternate handle attachment apparatus is shown in FIGS. 7 and 8; this apparatus accommodates a plurality of differently sized shafts of golf clubs and retrievers. Upstanding side plates 64, 66 are welded atop retrieving means 14 and are interconnected at longitudinally spaced intervals by a plurality of interconnecting members in the form of bolts or pins 68. Note that each plate 64, 66 increases in height in a proximal-to-distal direction. Accordingly, as depicted in FIG. 7, a shaft having a small diameter will be wedgingly engaged by the most proximal pin 69. A larger in diameter shaft will be wedgingly engaged by the next most proximal pin when said most proximal pin is removed, and so on.

Figure 3:
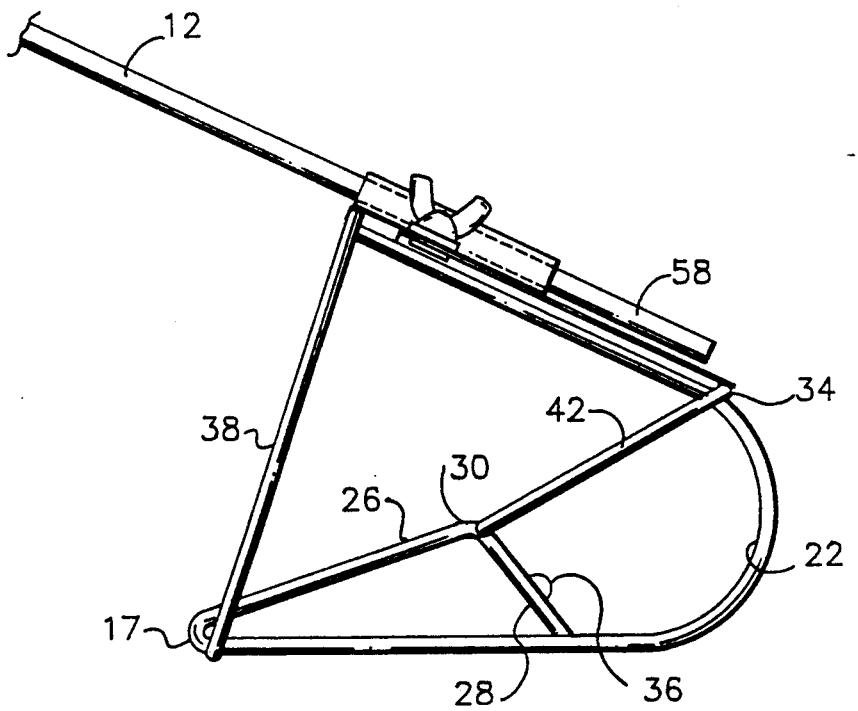
FIG. 3 is a side elevational view of the device.
Figure 9:
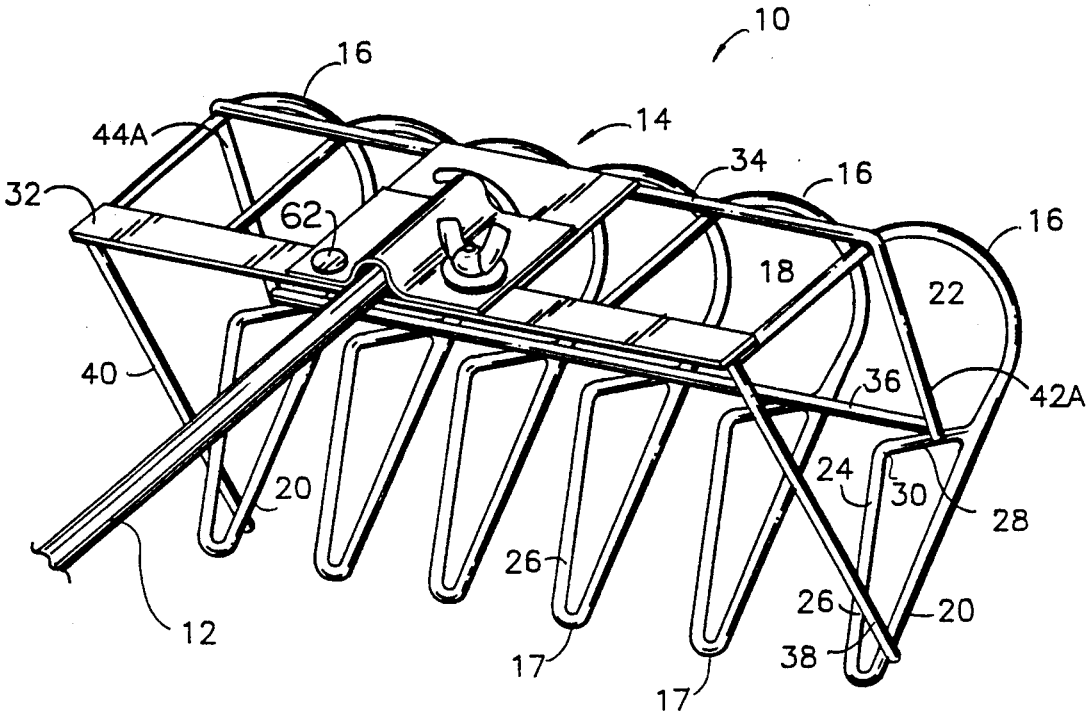
FIG. 9 is a perspective view of a second embodiment of the invention.
Figure 10:
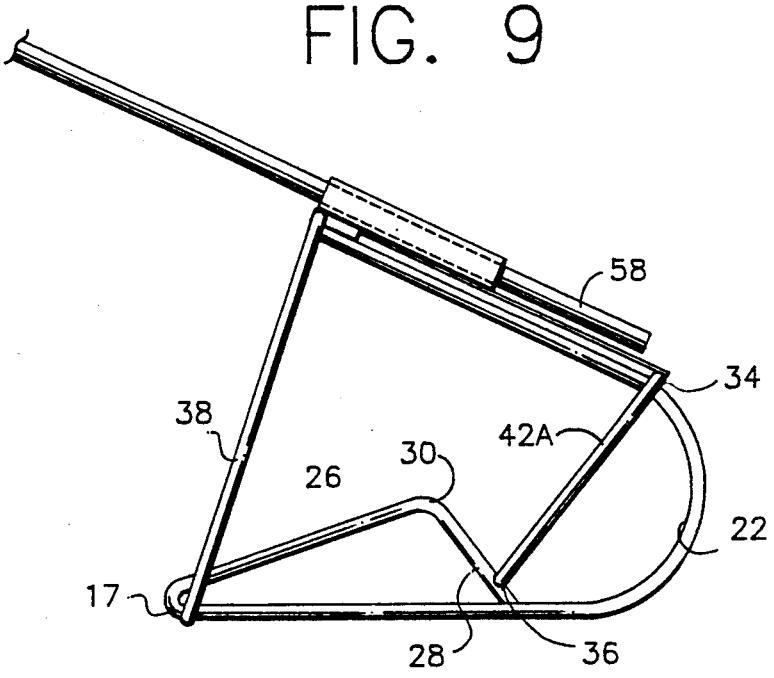
FIG. 10 is a side elevational view of said second embodiment.

A second embodiment of the retrieval apparatus 14 is depicted in FIGS. 9 and 10. It differs from the first embodiment in one important aspect; note that the lowermost ends of rearward braces 42A, 44A are not secured to apex 30 of their associated outer tines as in the first embodiment (see FIGS. 1 and 3). Instead, said lowermost ends are connected to said outer tines at the same location thereon where the opposite ends of stabilizer bar 36 are connected thereto. Thus, one welding procedure accomplishes two connections.

This invention is clearly new and useful because many of its features were heretofore unknown. Moreover, it was not obvious to those of ordinary skill in this art at the time it was made, in view of the prior art as a whole.

It will thus be seen that the objects set forth above and those made apparent by the foregoing description are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device for retrieving golf balls, comprising:

an elongate handle having a distal end;

a retrieving means mounted to the distal end of said handle;

said retrieving means including a plurality of interconnected "U"-shaped tine members;

each of said tine members being longitudinally aligned in parallel relation to said handle and in transversely spaced apart, parallel relation to one another;

each of said tine members being disposed in a vertical plane, having a leading open end disposed toward a user of said device and having a closed end disposed remote from said user;

each of said tine members including a top part, a bottom part, and a bight part having a return bend that interconnects respective trailing ends of said top and bottom parts;

a triangular ball-trapping means mounted to each of said tine members at the respective bottom parts thereof;

said triangular ball-trapping means including a rearwardly extending leading part having an upwardly inclined predetermined angle of inclination and a rearwardly extending trailing part having a downwardly inclined predetermined angle of inclination;

said downwardly inclined predetermined angle of inclination of said rearwardly extending trailing part being greater than said upwardly inclined predetermined angle of inclination of said rearwardly extending leading part so that a golf ball may easily roll up said upwardly inclined predetermined angle of inclination to enter the bight part of said tine members but may not easily roll in a reverse direction up said downwardly inclined predetermined angle of inclination to escape from said bight part;

an apex being formed where said leading and trailing parts meet;

a transversely disposed forward stabilizer bar that interconnects respective leading ends of the top parts of the tine members and which dislodges weeds and grasses to enable a golf ball to enter the open ends of said tine members;

a transversely disposed rear stabilizer bar that interconnects respective trailing ends of the top parts of said tine members to maintain the transverse spacing of said tine members with respect to one another;

a transversely disposed lower stabilizer bar that interconnects respective trailing ends of said downwardly extending trailing parts to maintain the transverse spacing of said tine members with respect to one another;

a pair of forward braces for interconnecting respective leading ends of the top and bottom parts of the outermost tine members of said retrieving means to enhance the structural integrity thereof; and a pair of rearward braces for interconnecting opposite ends of said rear stabilizer bar to the respective apexes of the triangular ball trapping means;

whereby the user of the device retrieves submerged golf balls from water where weeds and grasses are growing by employing a raking action, said ball trapping means easily admitting a golf ball into a bight region of said tine members while denying easy egress therefrom.

2. The device of claim 1, further comprising means for enabling ninety degree rotation of said handle with respect to said retrieving means to facilitate storage of the device when it is not in use.

3. The device of claim 2, wherein said means for enabling ninety degree rotation includes a flat plate having an arcuate slot formed therein, a bridge means, said distal end of said handle being disposed in sandwiched relation between said flat plate and said bridge means, an arch formed in said bridge means for arching over said distal end of said handle, a first rivet means for pivotally securing a first end of said bridge means to said flat plate, a second rivet means that extends through said arcuate slot, and means for selectively tightening and loosening said second rivet means so that said retrieving means is rotatable with respect to said handle when said means for selectively loosening and tightening said second rivet means is loosened.

4. The device of claim further comprising a pair of elongate side plates disposed on opposite sides of the distal end of said handle, each of said side plates increasing in height in a proximal-to-distal direction, and a plurality of longitudinally spaced apart interconnecting means for successively wedgingly engaging handles of increasing diameters, a handle of small diameter being engaged by a most proximal of said interconnecting means, a handle diameter being engaged by a more distal interconnecting means when said most proximal interconnecting means is removed.

5. A device for retrieving golf balls, comprising:

an elongate handle having a distal end;

a retrieving means mounted to the distal end of said handle;

said retrieving means including a plurality of interconnected "U"-shaped tine members;

each of said tine members being longitudinally aligned in parallel relation to said handle and in transversely spaced apart, parallel relation to one another;

each of said tine members being disposed in a vertical plane, having a leading open end disposed toward a user of said device and having a closed end disposed remote from said user;

each of said tine members including a top part, a bottom part, and a bight part having a return bend that interconnects respective trailing ends of said top and bottom parts;

a triangular ball-trapping means mounted to each of said tine members at the respective bottom parts thereof;

said triangular ball-trapping means including a rearwardly extending leading part having an upwardly inclined predetermined angle of inclination and a rearwardly extending trailing part having a downwardly inclined predetermined angle of inclination;

said downwardly inclined predetermined angle of inclination of said rearwardly extending trailing part being greater than said upwardly inclined predetermined angle of inclination of said rearwardly extending leading part so that a golf ball may easily roll up said upwardly inclined predetermined angle of inclination to enter the bight part of said tine members but may not easily roll in a reverse direction up said downwardly inclined predetermined angle of inclination to escape from said bight part;

an apex being formed where said leading and trailing parts meet;

a transversely disposed forward stabilizer bar that interconnects respective leading ends of the top parts of the tine members and which dislodges weeds and grasses to enable a golf ball to enter the open ends of said tine members;

a transversely disposed rear stabilizer bar that interconnects respective trailing ends Of the top parts of said tine members to maintain the transverse spacing of said tine members with respect to one another;

a transversely disposed lower stabilizer bar that interconnects respective trailing ends of said downwardly extending trailing parts to maintain the transverse spacing of said tine members with respect to one another;

a pair of forward braces for interconnecting respective leading ends of the top and bottom parts of the outermost tine members of said retrieving means to enhance the structural integrity thereof; and a pair of rearward braces disposed in interconnecting relation between opposite ends of said rear stabilizer bar and opposite ends of said lower stabilizer bar;

whereby the user of the device retrieves submerged golf balls from water where weeds and grasses are growing by employing a raking action, said ball trapping means easily admitting a golf ball into a bight region of said tine members while denying easy egress therefrom.

6. The device of claim 5, further comprising means for enabling ninety degree rotation of said handle with respect to said retrieving means to facilitate storage of the device when it is not in use.

7. The device of claim 6, wherein said means for enabling ninety degree rotation includes a flat plate having an arcuate slot formed therein, a bridge means, said distal end of said handle being disposed in sandwiched relation between said flat plate and said bridge means, an arch formed in said bridge means for arching over said distal end of said handle, a first rivet means for pivotally securing a first end of said bridge means to said flat plate, a second rivet means that extends through said arcuate slot, and means for selectively tightening and loosening said second rivet means so that said retrieving means is rotatable with respect to said handle when said means for selectively loosening and tightening said second rivet means is loosened.

8. The device of claim 5, further comprising a pair of elongate side plates disposed on opposite sides of the distal end of said handle, each of said side plates increasing in height in a proximal-to-distal direction, and a plurality of longitudinally spaced apart interconnecting means for successively wedgingly engaging handles of increasing diameters, a handle of small diameter b engaged by a most proximal of said interconnecting means, a handle diameter being engaged by a more distal interconnecting means when said most proximal interconnecting means is removed.

* * * * *